US007722216B2

(12) United States Patent
Amor et al.

(10) Patent No.: US 7,722,216 B2
(45) Date of Patent: May 25, 2010

(54) LED LIGHTING APPARATUS IN A PLASTIC HOUSING

(76) Inventors: Grant Harold Amor, Unit 4, 54 Siganto Drive, Helensvale, Qld 4212 (AU); Carl Denis Amor, Unit 4, 54 Siganto Drive, Helensvale, Qld 4212 (AU)

( * ) Notice: Subject to any disclaimer, the term of this patent is extended or adjusted under 35 U.S.C. 154(b) by 231 days.

(21) Appl. No.: 11/885,771

(22) PCT Filed: Mar. 8, 2006

(86) PCT No.: PCT/AU2006/000300

§ 371 (c)(1),
(2), (4) Date: Sep. 6, 2007

(87) PCT Pub. No.: WO2006/094346

PCT Pub. Date: Sep. 14, 2006

(65) Prior Publication Data

US 2008/0165547 A1 Jul. 10, 2008

(30) Foreign Application Priority Data

Mar. 8, 2005 (AU) ..... 2005901081

(51) Int. Cl.
*F21V 17/00* (2006.01)

(52) U.S. Cl. ..... 362/249.01; 362/294; 362/101; 362/376; 362/153

(58) Field of Classification Search ..... 362/153, 362/153.1, 373, 294, 376, 231, 101
See application file for complete search history.

(56) References Cited

U.S. PATENT DOCUMENTS 4,156,894 A 5/1979 Berry
4,245,281 A 1/1981 Ziaylek, Jr.
4,360,859 A 11/1982 Ziaylek, Jr. et al.

(Continued)

FOREIGN PATENT DOCUMENTS

DE 20104098 7/2001

(Continued)

OTHER PUBLICATIONS

"Aqualights Marine Underwater Lighting", [online]. © 2004 Aqua Lights. [retrieved Jul. 25, 2005]. Retrieved from the Internet: <URL: http://aqualights.org/lights_page.htm>, 2 pgs.

(Continued)

*Primary Examiner*—Anabel M Ton
(74) *Attorney, Agent, or Firm*—Schwegman, Lundberg & Woessner, P.A.

(57) ABSTRACT

A lighting apparatus (2) includes a housing (4) of plastic material, the housing (4) defining a translucent window (12), and a light emitting diode assembly (3) on a printed circuit board (34). The apparatus (2) may be attached to the hull (14) of a boat by means of a flange (10) and a nut (16). The apparatus (2) may include a heat sink (36) machined from a solid aluminum bar. The housing (4) may be connected to a sealing cap (6). The housing (4) is preferably injection-molded from a thermoplastic material such as polycarbonate. Electrical wires may extend through a central bore (42) of the heat sink (36) and the sealing cap (6).

18 Claims, 4 Drawing Sheets

U.S. PATENT DOCUMENTS

| | | | | |
|---|---|---|---|---|
| 4,445,163 | A | 4/1984 | Ziaylek, Jr. | |
| 4,574,337 | A | 3/1986 | Poppenheimer | |
| 5,016,151 | A | 5/1991 | Mula | |
| 5,045,978 | A | 9/1991 | Gargle | |
| 5,070,437 | A | 12/1991 | Roberts, Sr. | |
| 5,152,242 | A | 10/1992 | Bradley | |
| 5,211,469 | A | 5/1993 | Matthias et al. | |
| 5,268,824 | A | 12/1993 | Czipri | |
| 5,285,359 | A | 2/1994 | Czipri | |
| 5,800,041 | A | 9/1998 | Poggi | |
| 5,947,047 | A | 9/1999 | Sigler | |
| 6,158,873 | A | 12/2000 | Griffiths | |
| 6,168,294 | B1 * | 1/2001 | Erni et al. | 362/298 |
| 6,170,969 | B1 | 1/2001 | Dumse | |
| 6,184,628 | B1 | 2/2001 | Ruthenberg | |
| 6,210,017 | B1 * | 4/2001 | Miura et al. | 362/153.1 |
| 6,315,429 | B1 | 11/2001 | Grandolfo | |
| 6,435,691 | B1 | 8/2002 | Macey et al. | |
| 6,472,823 | B2 | 10/2002 | Yen | |
| 6,491,407 | B1 * | 12/2002 | Beadle | 362/153 |
| 6,565,239 | B2 * | 5/2003 | Rizkin et al. | 362/373 |
| 6,616,291 | B1 | 9/2003 | Love | |
| 6,902,291 | B2 * | 6/2005 | Rizkin et al. | 362/153.1 |
| 7,300,186 | B2 * | 11/2007 | Cuypers et al. | 362/364 |
| 2004/0240209 | A1 | 12/2004 | Snow, Jr. et al. | |
| 2005/0111222 | A1 | 5/2005 | Olsson et al. | |

FOREIGN PATENT DOCUMENTS

| | | |
|---|---|---|
| DE | 20307610 | 9/2003 |
| GB | 2413840 | 11/2005 |
| JP | 2001-357703 | 12/2001 |
| WO | WO-2005108203 A1 | 11/2005 |

OTHER PUBLICATIONS

"EMAUX China "UL-P" Series Plastic Underwater Light", [online]. © 1999-2005, Alibaba.com. [retrieved Jul. 25, 2005]. Retrieved from the Internet: <URL: http://emaux.en.alibaba.com/product/50039695/50179955/UL__P100__Plastic__underwater__light/__UL__P__Series__Plastic__Underwater__Light.html>,4 pgs.

"Light Up the Ocean", [online]. © 2005 Light Up the Ocean. [retrieved Jul. 25, 2005]. Retrieved from the Internet: <URL: http://www.lightuptheocean.com>, 1 pg.

"Light Up the Ocean—Fiber Optic Underwater Lights", [online]. © 2005 Light Up the Ocean. [retrieved Jul. 25, 2005]. Retrieved from the Internet: <URL: http://www.lightuptheocean.com/fiber.asp>, 1 pg.

"Light Up the Ocean—Stainless Steel Underwater Lights", [online]. © 2004 Light Up the Ocean. [retrieved: Jul. 25, 2005]. Retrieved from the Internet: <URL: http://www.lightuptheocean.com/stainless.asp>,1 pg.

"Marine Underwater Lights", [online]. © 2004 Underwater Lights USA, LLC. [retrieved Jul. 25, 2007]. Retrieved from the Internet: <URL: http://www.underwaterlightsusa.com/underwaterlights.html>, 3 pgs.

"Underwater Boat Lights", [online]. © 2005 Apex Lighting, Inc. [retrieved Jul. 25, 2005]. Retrieved from the Internet: <URL: http://www.yachtlights.com/underwaterlights.html>, 2 pgs.

* cited by examiner

LED LIGHTING APPARATUS IN A PLASTIC HOUSING

RELATED APPLICATIONS

This application is a nationalization under 35 U.S.C. 371 of PCT/AU2006/000300, filed Mar. 8, 2006 and published as WO 2006/094346 A1 on Sep. 14, 2006, which claimed priority under 35 U.S.C. 119 to Australian Patent Application Serial No. 2005901081, filed Mar. 8, 2005; which applications and publication are incorporated herein by reference and made a part hereof.

TECHNICAL FIELD

The present invention relates to a lighting apparatus and to a light fitting which forms part of the lighting apparatus. The present invention has particular, although not exclusive application to lighting arrangements to be fitted in exposed environments, such as moist or underwater environments or areas of high traffic, such as walkways.

BACKGROUND

Many boats have underwater lights fitted to their hull. The lights are typically located beneath the water level in use and, in the event of a globe failure, must be removed from the water so that the globe can be replaced. Accordingly, globes are often not replaced until the boat is raised from the water, which is a costly and therefore infrequent occurrence.

There exist underwater and other mounted lights having consumable components which can be removed in situ. However, such lights usually have an exposed window sealing arrangement that can be prone to corrosion and leakage.

Furthermore, presently available underwater lights use water to keep the lights cool. This is necessary since without the cooling effect of the water, seals of the sealing arrangements of such lights can be damaged by the heat of the lights. As a result, when used on boats, it is necessary to turn the lights off when the boat is planing since the lights invariably rise out of the water.

For example, many underwater or other mounted lights have a metal housing of a bronze or stainless steel material, to which a glass window assembly is fitted. The glass window assembly typically includes a window holder, a glass window and a seal mounted there-between so as to impede water from entering the metal housing. The window assembly is relatively complicated in its construction and can be prone to leakage when the seal wears out. Furthermore, since the housing is electrically conductive it can cause galvanic corrosion of itself or a mounting plate or wall if such components are also of metal.

It will be appreciated that since glass is inherently brittle, it can be damaged, at least by cracking, when exposed to impact. As a result, presently available lights mounted in public areas are often damaged by vandals or environmental conditions.

SUMMARY OF THE INVENTION

According to a first aspect of the present invention, there is provided a lighting apparatus including:

- a housing of a plastic material, the housing defining a translucent window; and
- a light emitting diode (LED) assembly located within the housing to emit light through the translucent window.

It will be appreciated that the window is integral with the housing. Thus, there is no need for a sealing arrangement to be provided for the housing.

The housing may be of a thermoplastic material. In particular, the housing may be of a polycarbonate material. Applicant has found polycarbonate particularly suitable since it has high strength, especially high impact strength.

The housing may include a cylindrical barrel defining an external thread. The housing may define a flanged head at an end of the barrel. The flanged head may define the translucent window. The housing may be injection molded. The lighting apparatus may further include a mounting nut for engaging with the thread so that a wall can be compressed between the head and the nut to mount the housing on the wall.

The lighting apparatus may further include a sealing cap for sealing the LED assembly within the housing. The sealing cap may include a pair of posts which engage with a pair of slots defined in the barrel so as to form a bayonet fitting. The sealing cap may also be of polycarbonate material. The sealing cap may define a circumferential, external recess in which an O-ring may be fitted. The sealing cap may also define an aperture in which an electrical connector can be mounted.

The LED assembly may include:

- at least one LED;
- a printed circuit board (PCB) to which the at least one LED is electrically coupled; and
- a heat sink located adjacent the PCB to which the at least one LED is thermally coupled.

The LED assembly may further include a guard defining at least one chamber for each receiving a respective LED.

The heat sink may be machined from a solid aluminium bar and may be anodized. The heat sink may define a central bore through which electrical wires can extend.

The LED assembly may further include a buck transformer to provide power to the at least one LED.

The window may include a lens for focusing light from the at least one LED.

According to a second aspect of the present invention, there is provided a light fitting including:

- a housing of a plastic material, the housing defining a translucent window and being shaped so that a light emitting diode (LED) assembly can be located in the housing to emit light through the translucent window.

According to a third aspect of the invention, there is provided a lighting apparatus including:

- a housing of a plastic material, the housing defining a translucent window; and
- a light emitting diode (LED) assembly located within the housing to emit light through the translucent window, wherein the plastic material is a thermoplastic material.

According to a fourth aspect of the invention, there is provided a lighting apparatus including:

- a housing of a plastic material, the housing defining a translucent window; and
- a light emitting diode (LED) assembly located within the housing to emit light through the translucent window, wherein the plastic material is selected to have a heat transfer coefficient sufficient to conduct heat from a heat sink of the LED assembly.

BRIEF DESCRIPTION OF THE DRAWINGS

Preferred features, embodiments and variations of the invention may be discerned from the following Detailed Description which provides sufficient information for those skilled in the art to perform the invention. The Detailed Description will make reference to a number of drawings as follows.

DETAILED DESCRIPTION OF PREFERRED EMBODIMENTS

Figure 1:
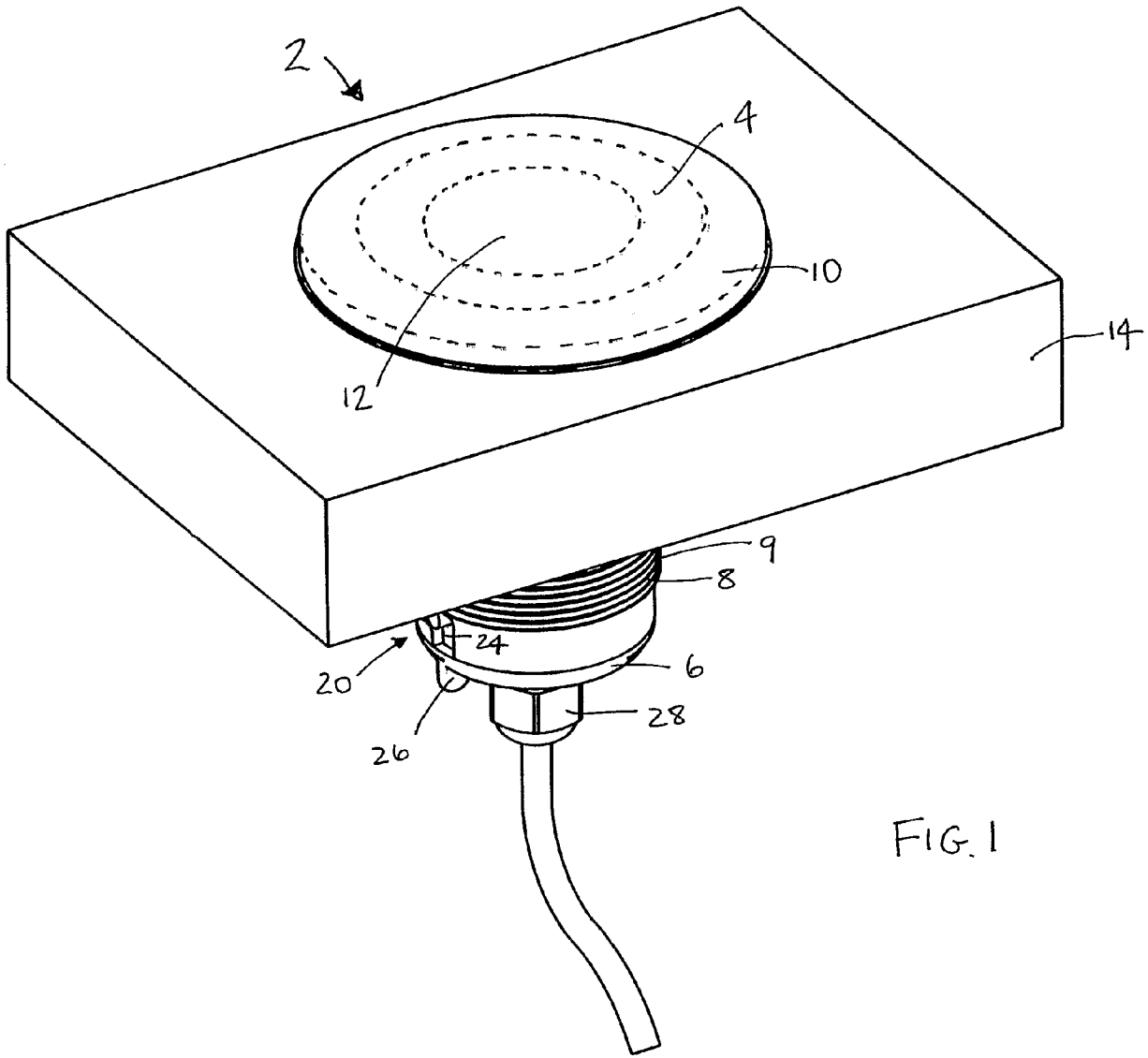
FIG. 1 is an upper perspective view of a lighting apparatus in accordance with a first embodiment of the present invention.
Figure 2:
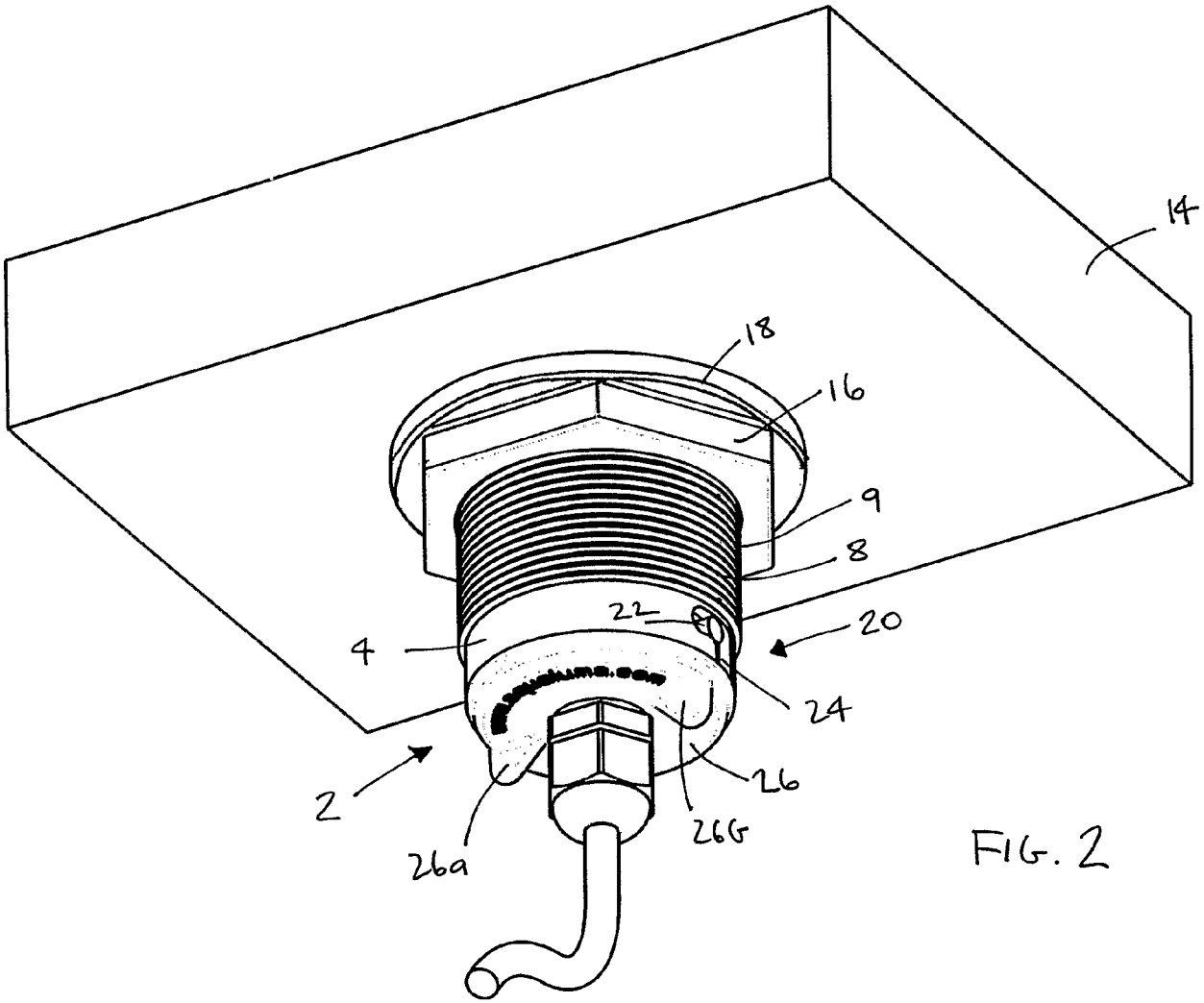
FIG. 2 is a lower perspective view of the lighting apparatus of FIG. 1.

According to a first embodiment of the present invention, there is provided a lighting apparatus 2 as shown in FIGS. 1 and 2. The lighting apparatus 2 includes a thermoplastic housing 4 having a flanged head 10, and a cylindrical barrel 8 extending from the flanged head 10. The flanged head 10 defines a translucent window 12 and, in use, a light emitting diode (LED) assembly 3 is located within the thermoplastic housing 4 so as to emit light through the translucent window. The lighting apparatus 2 includes a detachable sealing cap 6 engageable with the housing 4 in a substantially watertight manner for sealing the LED assembly 3 within the thermoplastic housing to thereby isolate the LED assembly 3 from an external environment, such as water, in use. In some embodiments, both the housing and the sealing cap are injection molded from the thermoplastic material. The thermoplastic material is polycarbonate in this example of the invention. As is known, polycarbonate is resistant to corrosion and electricity conduction. A detailed description of the lighting apparatus 2 is provided below.

It is thus to be appreciated that the housing 4 is a one-piece integrated structure. As will be seen below, this results in a structure which does not require a separate sealing arrangement for a window or lens, as is required with presently available lighting apparatus.

In the following description, reference is made to a hull. It is, however, to be appreciated that the lighting apparatus 2 can be mounted on any wall or member where adverse conditions exist. The use of the hull as a mounting area is simply to exemplify this particular example.

The cylindrical barrel 8 of the housing 4 defines an external thread 9 which can engage a mounting nut 16 when mounting the lighting apparatus 2 to a hull 14 of a boat. The hull 14 defines an aperture through which the barrel 8 can be passed. The nut 16 is engaged with the barrel 8 so that the hull 14 is compressed between the head 10 and the nut 16. A mounting washer 18 is typically provided between the hull 14 and the nut 16. A marine grade sealant is typically provided between the underside of the head 10 and the outside of the hull 14 to impede water from breaching the hull 14.

Turning to FIG. 2, a bayonet fitting 20 is used to engage the sealing cap 6 with the housing 4. The bayonet fitting 20 includes a pair of opposed posts 22 which extend from the sealing cap 6, and a pair of opposed elbow slots 24 defined at the tail of the barrel 8 and for each receiving a respective post 22. The sealing cap 6 further defines a pair 26 of wings **26*a* and 26*b* to facilitate hand engagement and disengagement of the sealing cap 6 with the housing 4. The sealing cap 6 also defines an aperture configured to receive an electrical connector 28 which can be mounted in a substantially watertight manner to provide an electrical power supply to the LED assembly 3**.

Figure 3:
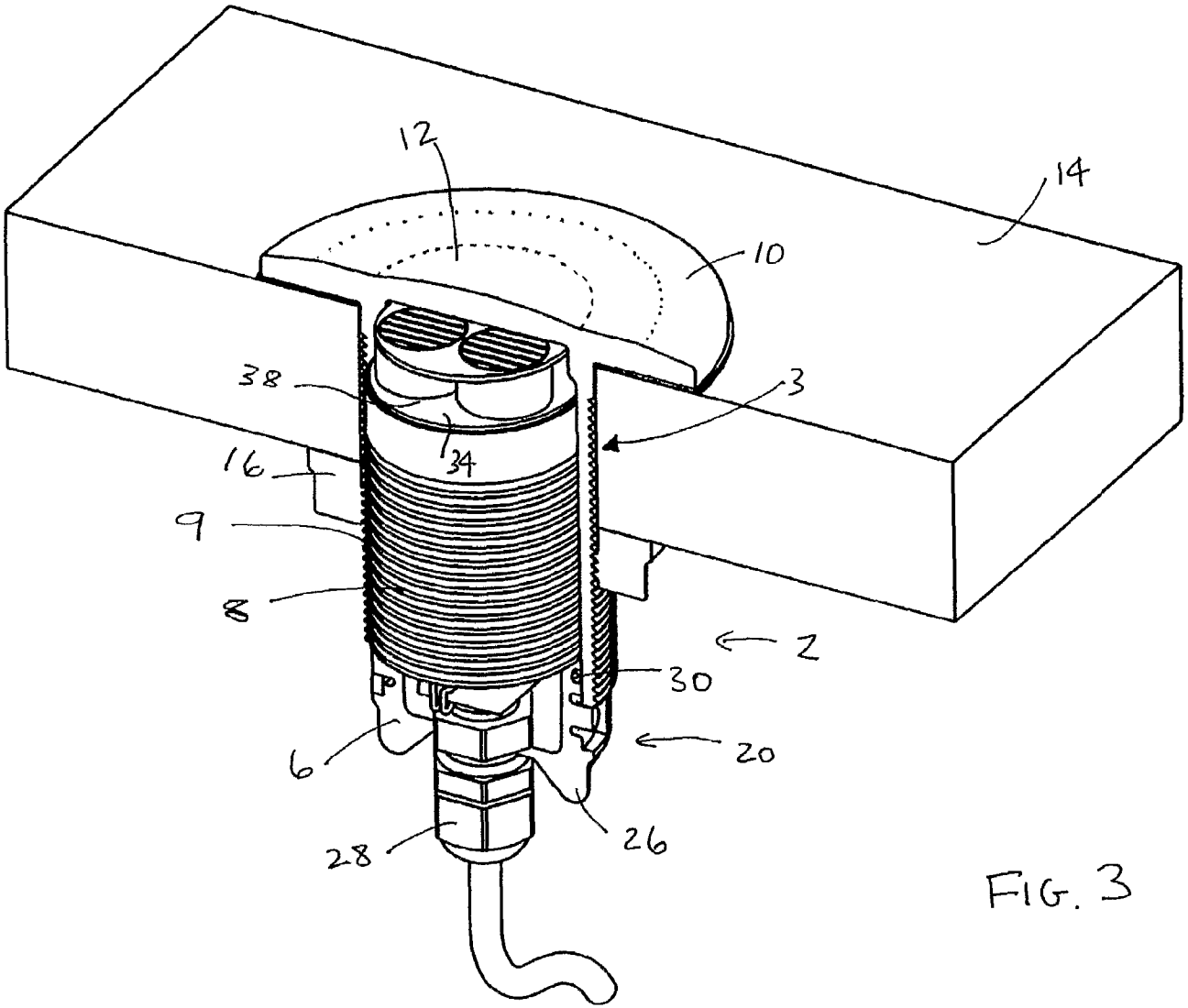
FIG. 3 is a partially cut-away upper perspective view of the lighting apparatus of FIG. 1.
Figure 4:
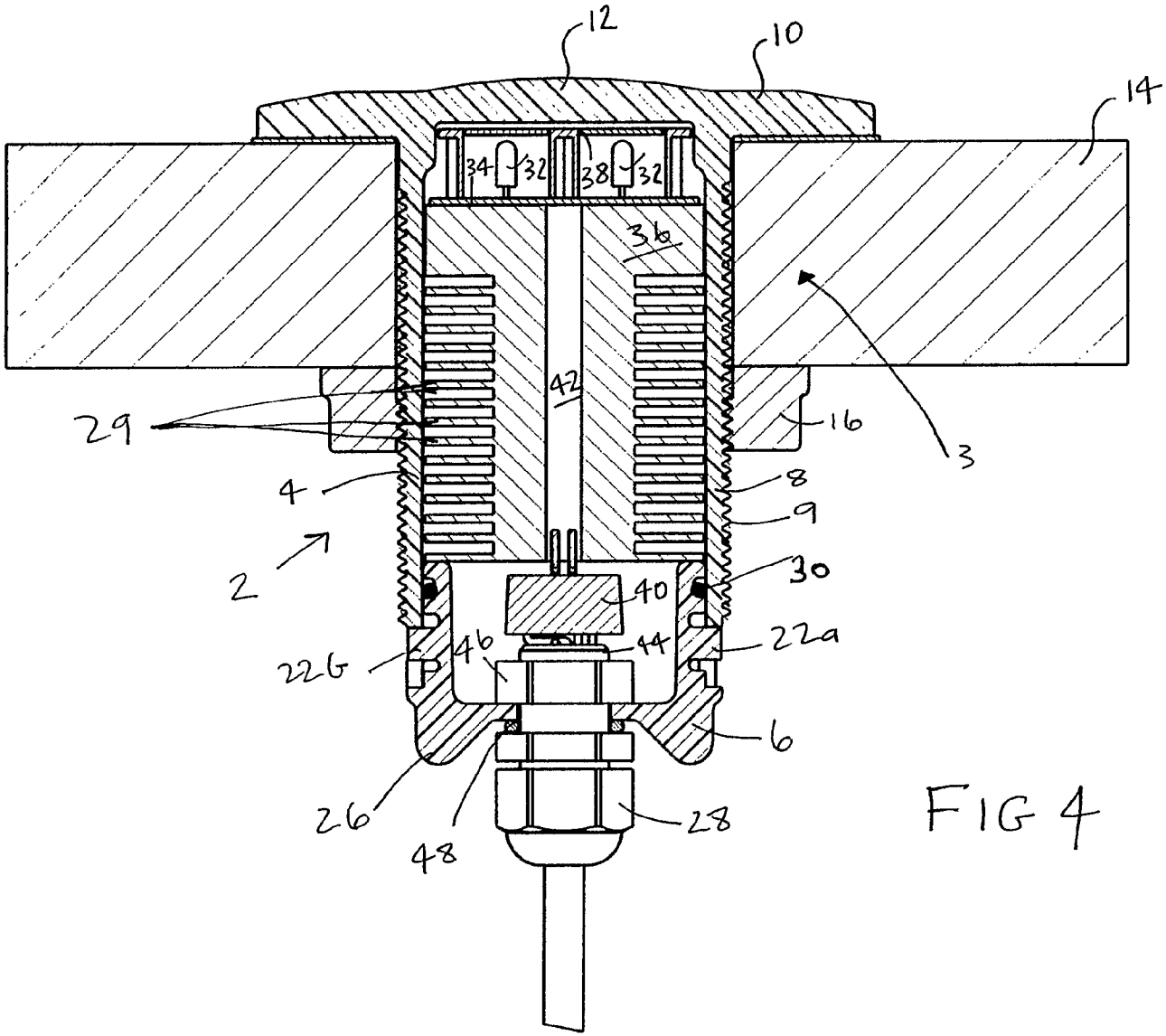
FIG. 4 is a side sectional view of the lighting apparatus of FIG. 1.

Turning to FIGS. 3 and 4, the sealing cap 6 defines a recess in which a rubber O-ring 30 may be fitted to impede water from entering the lighting apparatus 2. In this manner, the LED assembly 3 located in the housing 4 remains dry.

The LED assembly 3 includes a pair of light emitting diodes (LEDs) 32 which are electrically coupled to a printed circuit board (PCB) 34. An aluminium heat sink 36 is located adjacent the PCB 34 and is thermally coupled to the LED's 32. The heat sink 36 is machined from a solid aluminium bar, and may be anodized or coated electrolytically with a protective oxide. The heat sink 36 defines a plurality of fins 29 which each contact an inner surface of the barrel 8. In use, heat generated by the LED's 32 is thermally coupled to the heat sink 36 and, in turn, to the thermoplastic housing 4 before being dissipated in the surrounding air, hull 14 and water.

The thermoplastic material is thus selected to facilitate heat dissipation from the heat sink 36. Applicant has found that polycarbonate is well-suited to the task of such heat dissipation.

The LED assembly 3 further includes a guard 38 or holder which defines a pair of chambers for each receiving a respective LED 32. The guard 38 is typically affixed to the PCB 34. The sealing cap 6 is sized so that the LED assembly is held in compression between the flanged head 10 and the sealing cap 6. The sealing cap 6 further defines a cavity in which a buck transformer 40 is located. The buck transformer 40 is mounted and electrically coupled to the electrical connector 28 as shown in FIG. 4. Electrical wires (not shown) can be interconnected between the buck transformer 40 and the PCB 34 to provide power to the LED's 32, and extend along a central bore 42 defined by the heat sink 36. The buck transformer 40 typically provides between 5 and 32 volts to the LED's 32 and can be configured to supply voltage and current to the LED's 32 in accordance with the particular application.

The electrical connector 28 includes an enlarged base from which a threaded shaft 44 extends. The threaded shaft 44 extends through the aperture defined in the sealing cap 6 and engages with a mounting nut 46. An O-ring 48 can encircle the shaft 44 and be compressed between the enlarged base and the sealing cap 6 so as to impede water from entering the lighting apparatus 2. The watertight seals between the sealing cap 6 and the housing 4, and between the cap 6 and the connector 28 are each IP68 rated.

Advantageously, a user can quickly remove the cap 6 from the housing 4 when replacing LED's in the event of failure, without the need to raise the hull 14 from the water.

A person skilled in the art will appreciate that many embodiments and variations can be made without departing from the ambit of the present invention.

The embodiment described above was directed to an underwater lighting apparatus 2 for fitting to the hull 14 of a boat. The lighting apparatus would be also suitable for other applications such as lighting which is embedded in pavements or swimming pool walls. Another suitable application for the lighting apparatus would be as up lights for decorative or security purposes.

Polycarbonate has high impact strength. As a result, the lighting apparatus would be suitable for applications where light would usually be destroyed by vandals or the environment. In such applications, access to the housing can be designed to be in a secure area, while the translucent window is exposed to said vandals or the environment.

Where the lighting apparatus of the present invention is used in boats, Applicant has found that the combination of the LED's 32 and the one-piece housing 4 allows the lighting apparatus 2 to be used out of water. Thus, it is not necessary for the lighting apparatus 2 to be switched off when the boat is planing, for example. Applicant has found that the relatively low temperature of the LED's and the use of a one-piece housing remove the possibility of any seals being damaged by heat generated by the light source and consequently leaking.

Furthermore, since the lighting apparatus can be used without the need for cooling, Applicant can achieve a light source of high intensity without damaging the housing 4 in an out of water environment, such as those described above.

The invention has been described in language more or less specific to structural or methodical features. It is to be understood that the invention is not limited to specific features shown or described since the means herein described comprises forms of putting the invention into effect. The invention is, therefore, claimed in any of its forms or modifications within the proper scope of the appended claims appropriately interpreted by those skilled in the art.

The invention claimed is:

1. A lighting apparatus including:

a one-piece integral housing of a thermoplastic material, the housing defining a translucent window integrally formed with a cylindrical barrel extending from the window;

a light emitting diode (LED) assembly located within the housing to emit light through the translucent window, the LED assembly including an elongated heat sink positioned in the barrel, the heat sink thermally coupled to the barrel to facilitate heat dissipation from the heat sink; and a detachable sealing cap for sealing the LED assembly in the housing, the sealing cap being engageable with the housing in a substantially watertight manner and being configured to facilitate quick engagement and disengagement with the housing, the detachable sealing cap being configured to receive an electrical connector in a substantially watertight manner to provide an electrical power supply to the LED assembly.

2. A lighting apparatus as claimed in claim 1, wherein the housing is of a polycarbonate material.

3. A lighting apparatus as claimed in claim 1, wherein the heat sink defines a plurality of fins that make contact with the inner surface of the barrel.

4. A lighting apparatus as claimed in claim 1, wherein the cylindrical barrel defines an external thread.

5. A lighting apparatus as claimed in claim 4, wherein the housing defines a flanged head at an end of the barrel.

6. A lighting apparatus as claimed in claim 5, wherein the flanged head defines the translucent window.

7. A lighting apparatus as claimed in claim 4, further including a mounting nut for engaging with the thread so that a wall can be compressed between the head and the nut to mount the housing on the wall.

8. A lighting apparatus as claimed in claim 1, wherein the housing is injection molded.

9. A lighting apparatus as claimed in claim 1, wherein the sealing cap includes a pair of posts which can engage with a pair of slots defined in the housing so as to form a bayonet fitting.

10. A lighting apparatus as claimed in claim 9, wherein the sealing cap is of a polycarbonate material.

11. A lighting apparatus as claimed in claim 9, wherein the sealing cap defines a circumferential, external recess in which an O-ring may be fitted.

12. A lighting apparatus as claimed in claim 9, wherein the sealing cap defines an aperture in which the electrical connector can be mounted.

13. A lighting apparatus as claimed in claim 1, wherein the LED assembly includes:

at least one LED; and a printed circuit board (PCB) to which the at least one LED is electrically coupled, the heat sink being located adjacent the PCB to which the at least one LED is thermally coupled.

14. A lighting apparatus as claimed in claim 13, wherein the LED assembly further includes a guard defining at least one chamber for each receiving a respective LED.

15. A lighting apparatus as claimed in claim 13, wherein the heat sink is machined from a solid aluminium bar and is anodized.

16. A lighting apparatus as claimed in claim 13, wherein the heat sink defines a central bore through which electrical wires can extend.

17. A lighting apparatus as claimed in claim 14, wherein the LED assembly further includes a buck transformer to provide power to the at least one LED.

18. A lighting apparatus as claimed in claim 1, wherein the window includes a lens for focusing light from the at least one LED.

* * * * *